US010775729B2

(12) United States Patent
Hara et al.

(10) Patent No.: US 10,775,729 B2
(45) Date of Patent: Sep. 15, 2020

(54) REMAINING TONER AMOUNT DETECTING APPARATUS, REMAINING TONER AMOUNT DETECTING METHOD, AND RECORDING MEDIUM

(71) Applicants: Tetsuya Hara, Tokyo (JP); Masashi Hommi, Kanagawa (JP); Yuji Ieiri, Kanagawa (JP); Takumi Miyagawa, Tokyo (JP)

(72) Inventors: Tetsuya Hara, Tokyo (JP); Masashi Hommi, Kanagawa (JP); Yuji Ieiri, Kanagawa (JP); Takumi Miyagawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/743,421

(22) Filed: Jan. 15, 2020

(65) Prior Publication Data

US 2020/0233361 A1 Jul. 23, 2020

(30) Foreign Application Priority Data

Jan. 18, 2019 (JP) ..... 2019-007334

(51) Int. Cl.

| | |
|---|---|
| ***G03G 15/00*** | (2006.01) |
| ***G03G 15/08*** | (2006.01) |
| ***G03G 21/18*** | (2006.01) |

(52) U.S. Cl.

CPC ..... *G03G 15/556* (2013.01); *G03G 15/0856* (2013.01); *G03G 15/5045* (2013.01); *G03G 21/1875* (2013.01); *G03G 2215/0888* (2013.01)

(58) Field of Classification Search

CPC .. G03G 15/0856; G03G 15/086; G03G 15/50; G03G 15/5045; G03G 15/556; G03G 21/1875; G03G 2215/0888

See application file for complete search history.

(56) References Cited

U.S. PATENT DOCUMENTS

| | | | |
|---|---|---|---|
| 7,789,475 | B2 | 9/2010 | Morishita et al. |
| 7,819,492 | B2 | 10/2010 | Watanabe et al. |
| 8,764,143 | B2 | 7/2014 | Ieiri |
| 8,814,302 | B2 | 8/2014 | Ieiri |
| 9,054,545 | B2 | 6/2015 | Ieiri |
| 9,162,443 | B2 | 10/2015 | Ieiri |

(Continued)

FOREIGN PATENT DOCUMENTS

| | | |
|---|---|---|
| JP | 2012-113063 | 6/2012 |
| JP | 2018-066789 | 4/2018 |

*Primary Examiner* — Sophia S Chen

(74) *Attorney, Agent, or Firm* — IPUSA, PLLC

(57) ABSTRACT

A remaining toner amount detecting apparatus detects a remaining toner amount in a toner bottle. The remaining toner amount detecting apparatus includes at least one pair of electrodes that are configured to face each other with the toner bottle interposed between the electrodes; a first estimator configured to estimate the remaining toner amount based on a capacitance between the electrodes of the at least one pair of electrodes; a second estimator configured to estimate the remaining toner amount by counting a number of pixels in a printed image; and an estimation selector configured to use either one of the first estimator or the second estimator to output the remaining toner amount, based on a temperature or a humidity inside an apparatus in which the toner bottle is mounted.

6 Claims, 7 Drawing Sheets

(56) References Cited

U.S. PATENT DOCUMENTS

| | | | | |
|---|---|---|---|---|
| 9,440,431 | B2 | 9/2016 | Hommi | |
| 9,757,940 | B2 | 9/2017 | Hommi | |
| 10,163,045 | B2 | 12/2018 | Tanaka et al. | |
| 10,459,368 | B2 | 10/2019 | Inokuchi et al. | |
| 2004/0042804 | A1* | 3/2004 | Yamamoto | G03G 15/0896 399/27 |
| 2007/0183802 | A1* | 8/2007 | Kojima | G03G 15/50 399/54 |
| 2012/0148278 | A1* | 6/2012 | Isobe | G03G 15/086 399/53 |
| 2013/0272726 | A1* | 10/2013 | Sunahara | G03G 15/556 399/25 |
| 2015/0063839 | A1* | 3/2015 | Takahashi | G03G 15/556 399/27 |
| 2015/0355573 | A1* | 12/2015 | Jeong | G03G 15/0856 399/58 |
| 2018/0227150 | A1 | 8/2018 | Kemmochi et al. | |
| 2020/0033752 | A1* | 1/2020 | Kubo | G03G 15/0856 |

* cited by examiner

REMAINING TONER AMOUNT DETECTING APPARATUS, REMAINING TONER AMOUNT DETECTING METHOD, AND RECORDING MEDIUM

CROSS-REFERENCE TO RELATED APPLICATION

The present application is based on and claims priority under 35 U.S.C. § 119 to Japanese Patent Application No. 2019-007334, filed on Jan. 18, 2019, the contents of which are incorporated herein by reference in their entirety.

BACKGROUND OF THE INVENTION

1. Field of the Invention

The present invention relates to a remaining toner amount detecting apparatus, a remaining toner amount detecting method, and a recording medium.

2. Description of the Related Art

In an image forming apparatus of the electrophotographic method, there is a technology in which the toner amount in a toner bottle is detected as a change in the capacitance, to recognize the toner amount.

For example, Patent Document 1 discloses a configuration in which a plurality of pairs of electrodes are provided on the outside of the peripheral surface of a toner bottle along a longitudinal direction, the capacitance between the electrodes is measured for each pair of electrodes, and the toner distribution in the longitudinal direction of the toner bottle is calculated based on the change in the measured capacitance. Accordingly, the toner amount in the toner bottle can be more accurately detected.

Patent Document 1: Japanese Unexamined Patent Application Publication No. 2018-66789

SUMMARY OF THE INVENTION

According to one aspect of the present invention, there is provided a remaining toner amount detecting apparatus for detecting a remaining toner amount in a toner bottle, the remaining toner amount detecting apparatus including at least one pair of electrodes that are configured to face each other with the toner bottle interposed between the electrodes; a first estimator configured to estimate the remaining toner amount based on a capacitance between the electrodes of the at least one pair of electrodes; a second estimator configured to estimate the remaining toner amount by counting a number of pixels in a printed image; and an estimation selector configured to use either one of the first estimator or the second estimator to output the remaining toner amount, based on a temperature or a humidity inside an apparatus in which the toner bottle is mounted.

DETAILED DESCRIPTION OF THE PREFERRED EMBODIMENTS

Figure 1:
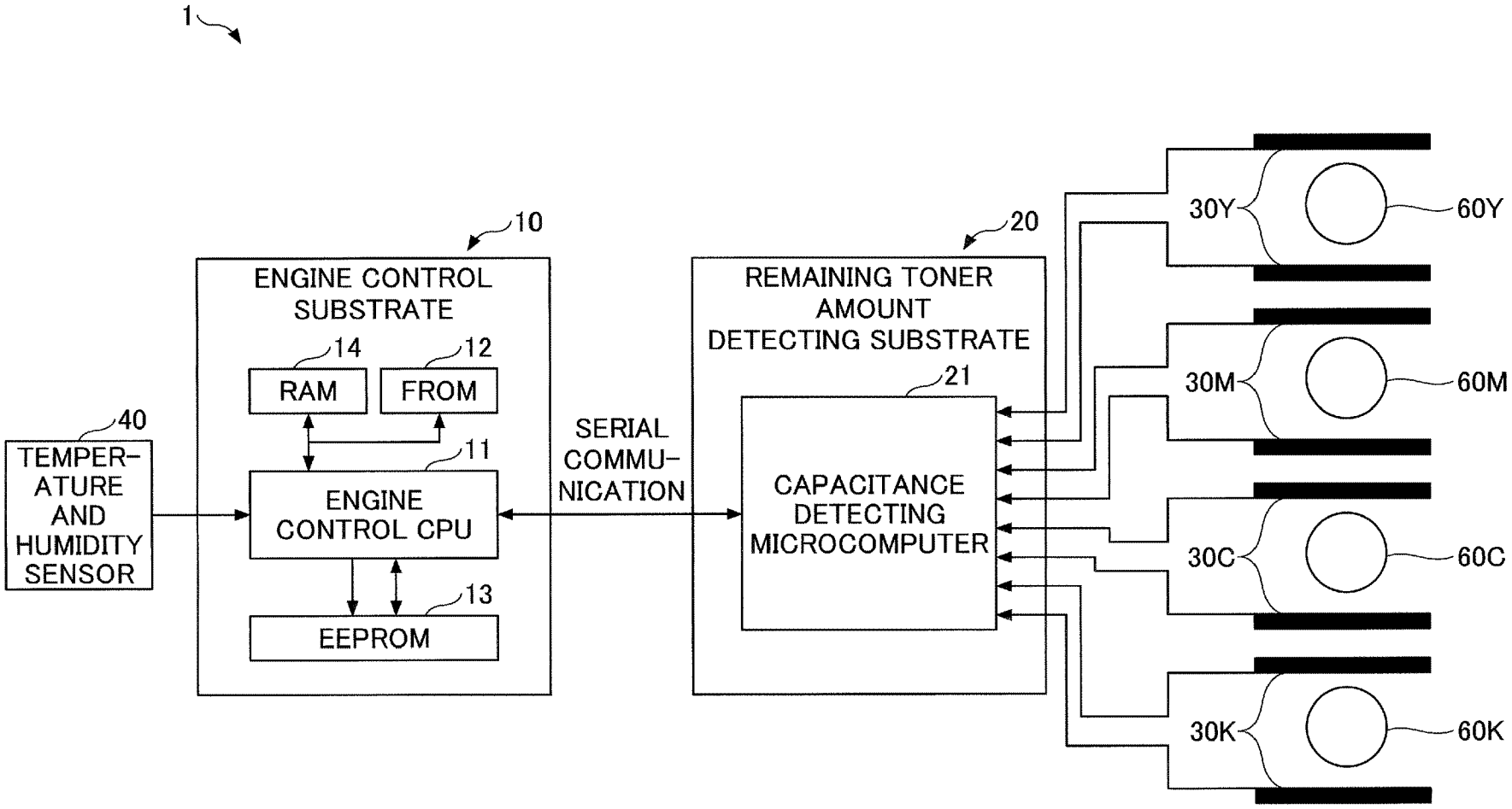
FIG. 1 is a diagram illustrating a hardware configuration of a remaining toner amount detecting apparatus according to an embodiment of the present invention.

In the capacitance method of the related art such as in Patent Document 1, when the humidity in the apparatus in which the toner bottle is placed is extremely high (for example, the humidity is 90% or more), there is a problem in that the toner amount cannot be correctly detected and a larger amount of toner than the actual amount of toner is detected. In this case, the toner absorbs the moisture in the air, and because the dielectric constant of toner is higher than that of water, an error occurs in the measured capacitance. Further, at a high temperature, the resin member to which the electrodes are attached is deformed due to thermal expansion, and, therefore, the distance between the electrodes changes, and the toner amount cannot be correctly detected.

A problem to be addressed by an embodiment of the present invention is to detect the remaining toner amount more accurately.

Hereinafter, embodiments will be described with reference to the accompanying drawings. In order to facilitate the understanding of the description, the same elements in the drawings are denoted by the same reference numerals as much as possible, and overlapping descriptions are omitted.

FIG. 1 is a hardware configuration diagram illustrating a remaining toner amount detecting apparatus 1 according to an embodiment.

The remaining toner amount detecting apparatus 1 is mounted in an image forming apparatus such as a printer, and detects the remaining toner amount in each of four toner bottles 60Y, 60M, 60C, and 60K in which toner of the corresponding color (yellow (Y), magenta (M), cyan (C), and black (B)) used for forming an image by the image forming apparatus is contained. The remaining toner amount detecting apparatus 1 can be mounted as a part of a toner supplying apparatus 70 (see FIG. 2) that supplies toner from the toner bottles 60Y, 60M, 60C, and 60K to a developing device of the image forming apparatus.

As illustrated in FIG. 1, the remaining toner amount detecting apparatus 1 includes an engine control substrate 10, a remaining toner amount detecting substrate 20, and pairs of plate electrodes (plate electrode pairs) 30Y, 30M, 30C, and 30K respectively disposed above and below the corresponding toner bottles 60Y, 60M, 60C, and 60K of the respective colors. Note that the four toner bottles 60Y, 60M, 60C, and 60K have the same configuration except that the color of the toner to be used is different, and the plate electrode pairs 30Y, 30M, 30C, and 30K have the same configuration except that the color of the toner to be used is different, and, therefore, in the following description and drawings, these may be referred to collectively as the toner bottle 60 and the plate electrode pair 30, respectively.

The engine control substrate 10 is an apparatus for controlling the printing engine of the image forming apparatus. The engine control substrate 10 includes an engine control Central Processing Unit (CPU) 11, which mainly manages engine control, a Flash Read-Only Memory (FROM) 12, which stores an engine control program, and an Electrically Erasable Programmable Read-Only Memory (EEPROM) 13, which stores a machine-specific setting value. Further, when the internal Static Random Access Memory (SRAM) of the engine control CPU 11 alone is insufficient, an external Random Access Memory (RAM) 14 may be mounted.

The engine control CPU 11 performs the following four control operations according to the present embodiment.

(1) Pixel count (2) Temperature and humidity detection (3) Remaining toner amount detection control by pixel count (4) Control to switch between the remaining toner amount detection control by a capacitance method and the remaining toner amount detection control by the pixel count The "pixel count" of the above-described (1) is a process of counting the number of pixels printed for each printed image, after the toner bottle 60 is attached to the image forming apparatus. The "remaining toner amount detection control by pixel count" in the above-described (3) is a process of estimating the toner usage amount based on the counted number of pixels and calculating the remaining toner amount in the toner bottle 60 based on the estimated toner usage amount.

The "temperature and humidity detection" in the above-described (2) is a process of detecting the temperature and humidity inside the image forming apparatus. A temperature and humidity sensor 40 is connected to the engine control CPU 11, and the internal temperature and humidity of the image forming apparatus are calculated based on the output of the temperature and humidity sensor 40. Note that the mounting position of the temperature and humidity sensor 40 may be any position as long as the temperature and humidity in the apparatus can be detected, and, therefore, there is no specified position. However, when the temperature and humidity sensor 40 is mounted near the fixing heater, it is highly likely that the correct temperature and humidity in the apparatus cannot be detected, and, therefore, the mounting position of the temperature and humidity sensor 40 is preferably a position that is not near the fixing heater. The switching control of the detection method of the remaining toner amount in the above-described (4) will be described later with reference to FIGS. 7 and 8.

The remaining toner amount detecting substrate 20 includes a capacitance detecting microcomputer 21. The capacitance detecting microcomputer 21 detects the remaining toner amount by the capacitance method, as a control operation according to the present embodiment.

The capacitance detecting microcomputer 21 is connected to the engine control CPU 11 mounted on the engine control substrate 10 by serial communication. The capacitance detecting microcomputer 21 is connected to the plate electrode pair 30 disposed above and below the toner bottle 60 of each color. The capacitance detecting microcomputer 21 detects a capacitance value between the electrodes of the plate electrode pair 30 and calculates the remaining toner amount in each toner bottle 60 based on the detected capacitance value.

Figure 2:
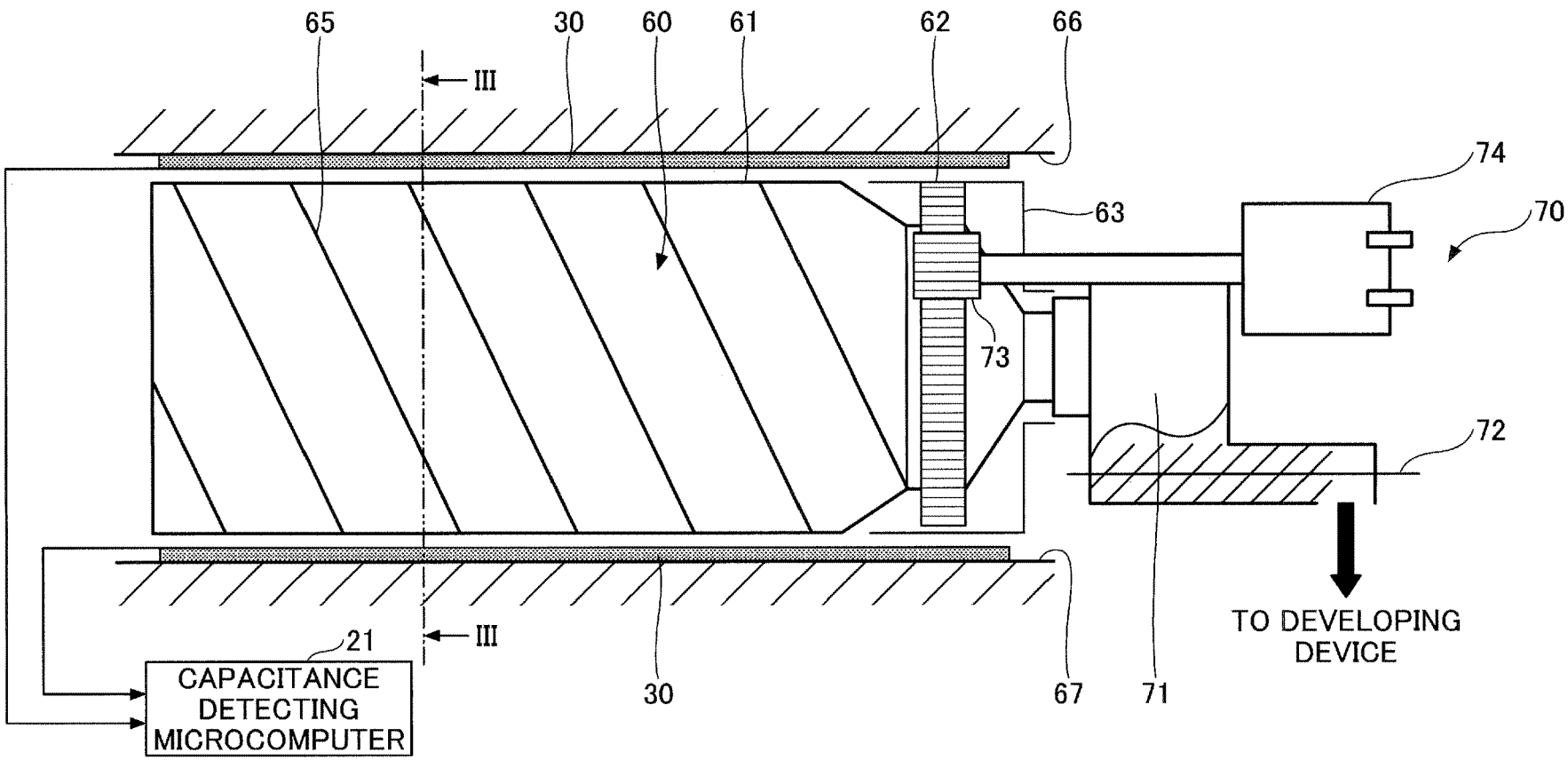
FIG. 2 is a schematic view illustrating an enlarged view of one of four toner bottles according to an embodiment of the present invention.
Figure 3:
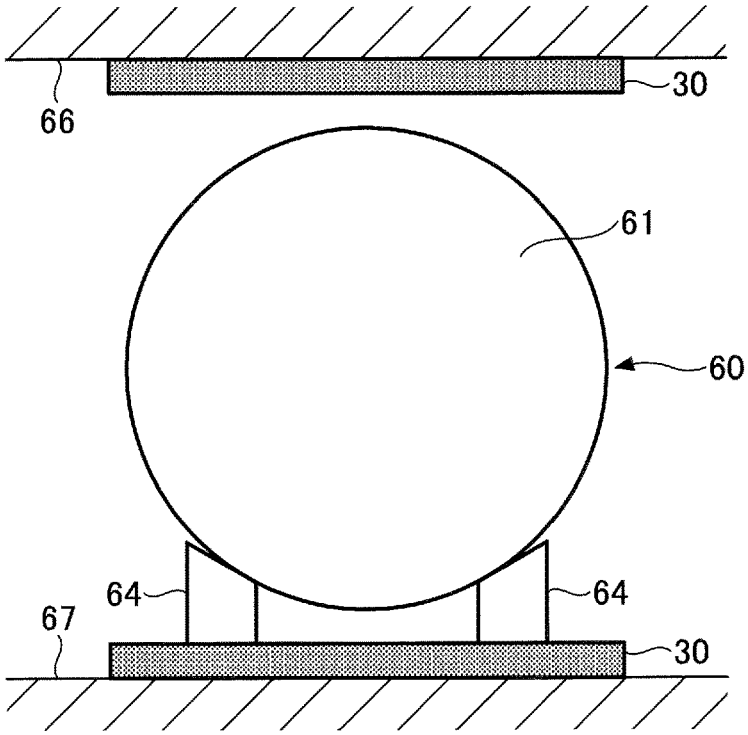
FIG. 3 is a cross-sectional view of along a line III-III in FIG. 2 according to an embodiment of the present invention.

FIG. 2 is a schematic diagram illustrating an enlarged view of one of the four toner bottles 60 in FIG. 1. FIG. 3 is a cross-sectional view along a line III-III in FIG. 2.

The toner bottle 60 is supported by two guide units 64 illustrated in FIG. 3. The toner bottle 60 is substantially cylindrical and, as illustrated in FIG. 2, the toner bottle 60 is formed mainly of a cap 63 held in a non-rotating manner in a toner container housing unit of the image forming apparatus and a container body 61 with which a gear 62 is integrally formed. The container body 61 is rotatably held relative to the cap 63, and the gear 62 engages with a drive output gear 73 of the toner supplying apparatus 70. When a driving motor 74 rotates the drive output gear 73, the drive is transmitted to the gear 62 of the container body 61, and the container body 61 is driven to rotate while the outer peripheral surface is guided by the guide units 64.

As the container body 61 rotates, the toner contained inside the container body 61 is conveyed from the left side to the right side in FIG. 2 along the longitudinal direction of the container body 61, by a spiral projection 65 formed in a spiral manner on the inner peripheral surface of the container body 61. The conveyed toner is discharged from the toner bottle 60 and the toner is supplied to a hopper unit 71 of the toner supplying apparatus 70. That is, as the container body 61 of the toner bottle 60 is rotatably driven by the driving motor 74 as appropriate, the toner is supplied to the hopper unit 71 as appropriate. The toner inside the hopper unit 71 is supplied to the developing device of the image forming apparatus by the rotation of a toner conveying screw 72. Each of the toner bottles 60Y, 60M, 60C, and 60K of one of the colors is replaced with a new toner bottle 60 when the toner bottle 60 reaches the end of the service life thereof (when almost all of the contained toner is consumed and the toner bottle 60 becomes empty).

As illustrated in FIGS. 2 and 3, one electrode of the plate electrode pair 30 is attached to an upper wall surface 66 of the toner bottle 60 and the other electrode of the plate electrode pair 30 is attached to a lower wall surface 67 of the toner bottle 60. That is, almost the entire toner bottle 60 is covered by the two electrodes of the plate electrode pair 30 from the upper direction and from the lower direction.

The plate electrode may be any electrically conductive member and, in the present embodiment, the plate electrode is a plate member made of iron. The capacitance detecting microcomputer 21 measures the capacitance between the two electrodes of the plate electrode pair 30 disposed as described above. The method of measuring the capacitance may be a general method, and in the present embodiment, the capacitance is measured by the charging method. Here, the "charging method" is a method in which a constant voltage and a constant current are applied between the electrodes and the capacitance is measured based on the relationship of the time point of reaching the charged state with the voltage and current. The capacitance varies according to the dielectric constant between the electrodes and the dielectric constant of toner is high relative to the dielectric constant of air, and, therefore, by measuring the capacitance, it is possible to detect the change in the toner amount in the toner bottle 60, and the remaining toner amount can be recognized.

Figure 4:
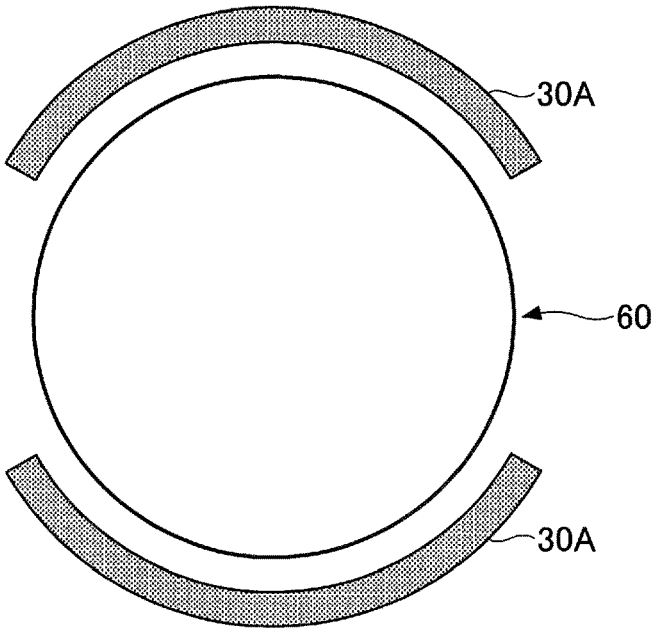
FIG. 4 is a schematic cross-sectional view illustrating an example in which an electrode pair is arc-shaped along an outer peripheral surface of a toner bottle according to an embodiment of the present invention.
Figure 5:
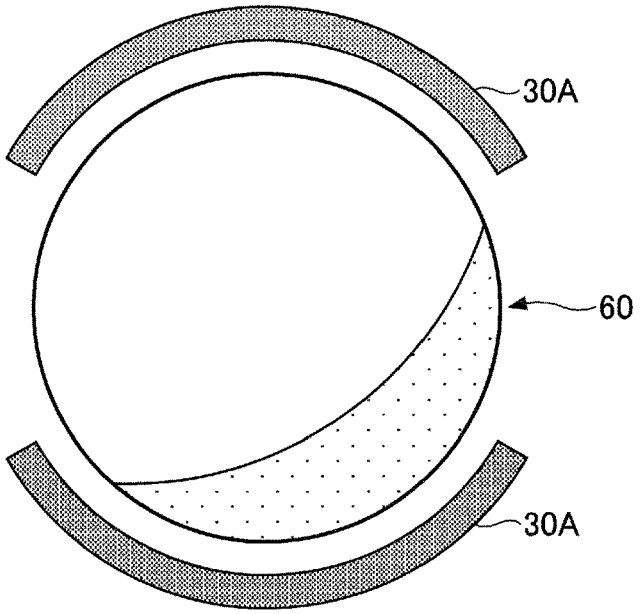
FIG. 5 is a schematic cross-sectional view illustrating a failure when the electrode pair is arc-shaped according to an embodiment of the present invention.
Figure 6:
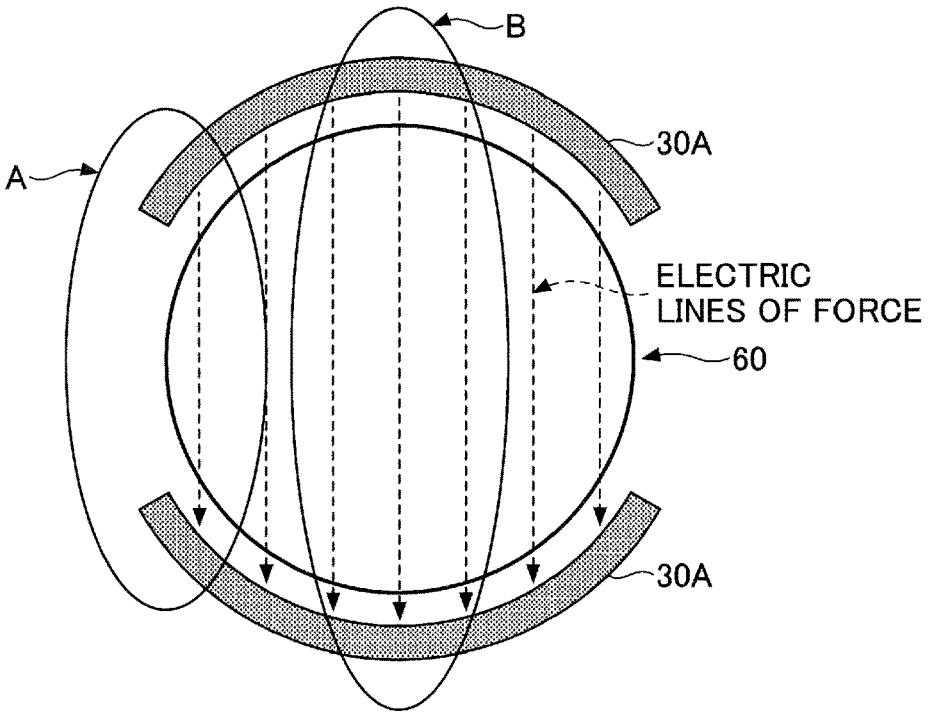
FIG. 6 is a schematic cross-sectional view illustrating a failure when the electrode pair is arc-shaped according to an embodiment of the present invention.

FIG. 4 is a schematic cross-sectional view illustrating an example in which each electrode in an electrode pair 30A has an arc shape along the outer peripheral surface of the toner bottle 60. FIGS. 5 and 6 are schematic cross-sectional views illustrating a failure in a case where the electrode pair 30A is made to have an arc shape. The overview of the cross-sectional views of FIGS. 4 to 6 is the same as that of FIG. 3.

In the present embodiment, each electrode of the electrode pair 30 is preferably a flat plate electrode; however, electrodes other than flat plate electrodes may be applied, such as the electrode pair 30A formed in an arc shape along the outer peripheral surface of the toner bottle 60, as illustrated in FIG. 4. However, the electrode pair 30A having an arc shape has the following disadvantages.

As illustrated in FIG. 5, the toner in the toner bottle 60 may be unevenly distributed. As illustrated in FIG. 6, in the case of the arc-shaped electrode pair 30A, the density of the electric lines of force differs between the A region at the end portion of the electrode and the B region at the center portion of the electrode. Therefore, there may be a difference in the capacitance between a state in which toner is unevenly distributed in the toner bottle 60 and a state in which toner is uniformly distributed. On the other hand, as illustrated in FIG. 3, when the plate electrode pair 30 is used, even when the toner is unevenly distributed as illustrated in FIG. 5, a constant value can be measured as the capacitance value regardless of the uneven distribution of the toner.

Figure 7:
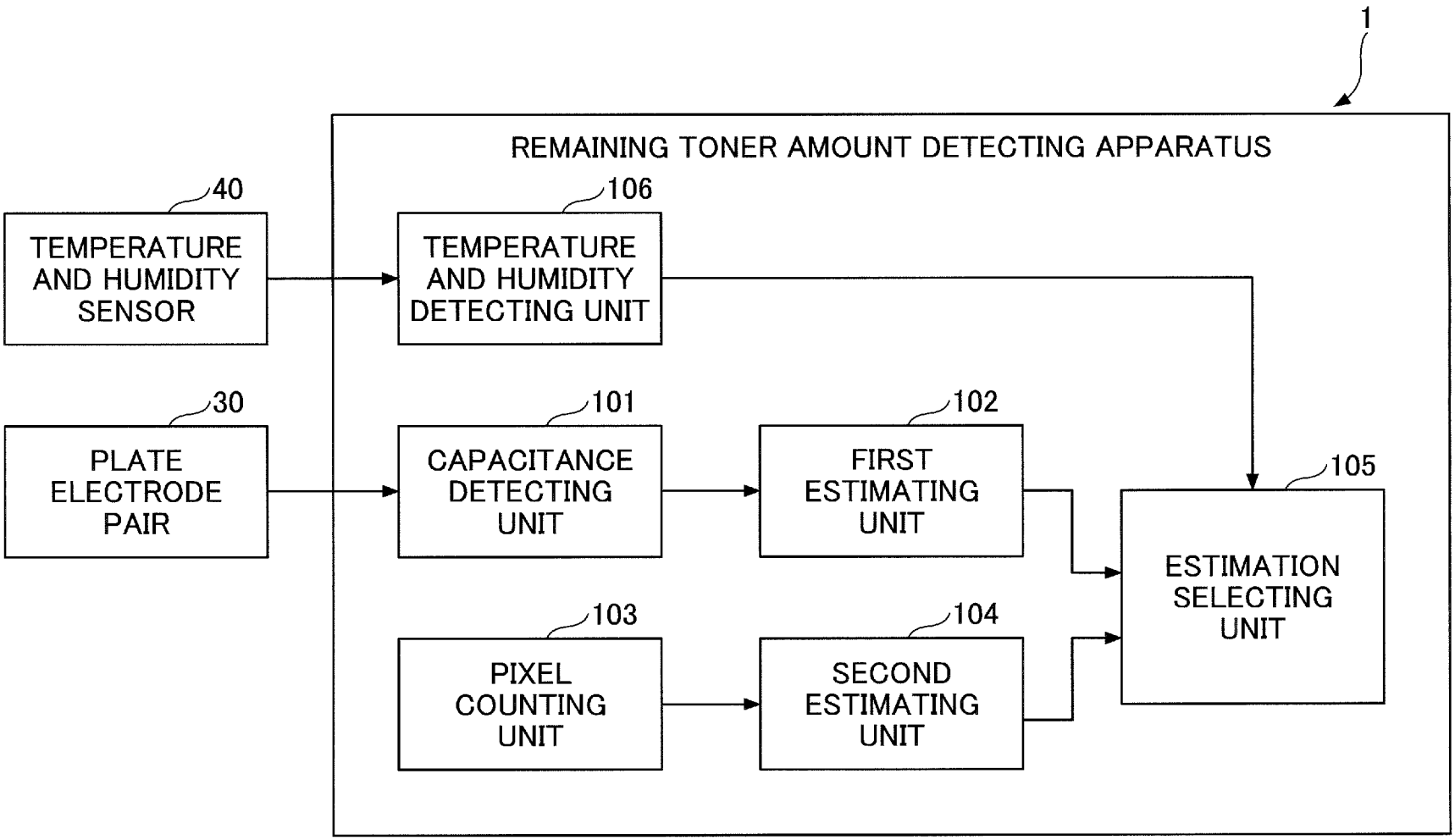
FIG. 7 is a functional block diagram of the remaining toner amount detecting apparatus according to an embodiment of the present invention.

FIG. 7 is a functional block diagram of the remaining toner amount detecting apparatus 1. As illustrated in FIG. 7, the remaining toner amount detecting apparatus 1 according to the present embodiment includes a capacitance detecting unit 101, a first estimating unit 102, a pixel counting unit 103, a second estimating unit 104, an estimation selecting unit 105, and a temperature and humidity detecting unit 106, as functions related to the remaining toner amount detection described above.

The capacitance detecting unit 101 detects the capacitance between the electrodes of the plate electrode pair 30 based on the output of the plate electrode pair 30.

The first estimating unit 102 estimates the remaining toner amount in the toner bottle 60 based on the capacitance detected by the capacitance detecting unit 101. That is, the first estimating unit 102 performs a remaining toner amount detection process of the capacitance method.

The pixel counting unit 103 counts the number of pixels of a printed image and outputs the accumulated number after the toner bottle 60 is attached to the image forming apparatus as the pixel count value.

The second estimating unit 104 estimates the remaining toner amount in the toner bottle 60 based on the pixel count value counted by the pixel counting unit 103. That is, the second estimating unit 104 performs the remaining toner amount detection process based on the pixel count.

The temperature and humidity detecting unit 106 detects the temperature and humidity in the apparatus in which the toner bottle 60 is mounted based on the output of the temperature and humidity sensor 40.

The estimation selecting unit 105 uses one of the first estimating unit 102 and the second estimating unit 104 for outputting the remaining toner amount based on the information of the temperature and humidity of the image forming apparatus detected by the temperature and humidity detecting unit 106.

More specifically, the estimation selecting unit 105 selects the first estimating unit 102 when the temperature detected by the temperature and humidity detecting unit 106 is less than a predetermined threshold value θ1 and the humidity detected by the temperature and humidity detecting unit 106 is less than a predetermined threshold value θ2, and uses the remaining toner amount detection process of the capacitance method for outputting the remaining toner amount. On the other hand, when the temperature is greater than or equal to the predetermined threshold value θ1 or the humidity is greater than or equal to the predetermined threshold value θ2, the estimation selecting unit 105 selects the second estimating unit 104 and uses the remaining toner amount detection process based on the pixel count to output the remaining toner amount. That is, when the temperature or humidity becomes greater than or equal to the threshold value θ1 or θ2, the estimation selecting unit 105 switches the estimating unit used for outputting the remaining toner amount from the first estimating unit 102 to the second estimating unit 104, and when the temperature or humidity falls below the threshold value θ1 or θ2, the estimation selecting unit 105 switches the estimating unit used for outputting the remaining toner amount from the second estimating unit 104 to the first estimating unit 102.

The functions of the pixel counting unit 103, the second estimating unit 104, the estimation selecting unit 105, and the temperature and humidity detecting unit 106 illustrated in FIG. 7 are implemented by reading and writing data with respect to the RAM 14 or the EEPROM 13 under the control of the engine control CPU 11 by loading predetermined computer software (a remaining toner amount detection program) stored in the FROM 12 into hardware such as the engine control CPU 11, the RAM 14, and the like, of the engine control substrate 10 of FIG. 1. Further, the functions of the capacitance detecting unit 101 and the first estimating unit 102 illustrated in FIG. 7 are implemented under the control of the CPU inside the capacitance detecting microcomputer 21, by loading predetermined computer software (a remaining toner amount detection program) into the capacitance detecting microcomputer 21 of the remaining toner amount detecting substrate 20. That is, by executing the remaining toner amount detection program according to the present embodiment on a computer, the remaining toner amount detecting apparatus 1 functions as the capacitance detecting unit 101, the first estimating unit 102, the pixel counting unit 103, the second estimating unit 104, the estimation selecting unit 105, and the temperature and humidity detecting unit 106 of FIG. 7.

Figure 8:
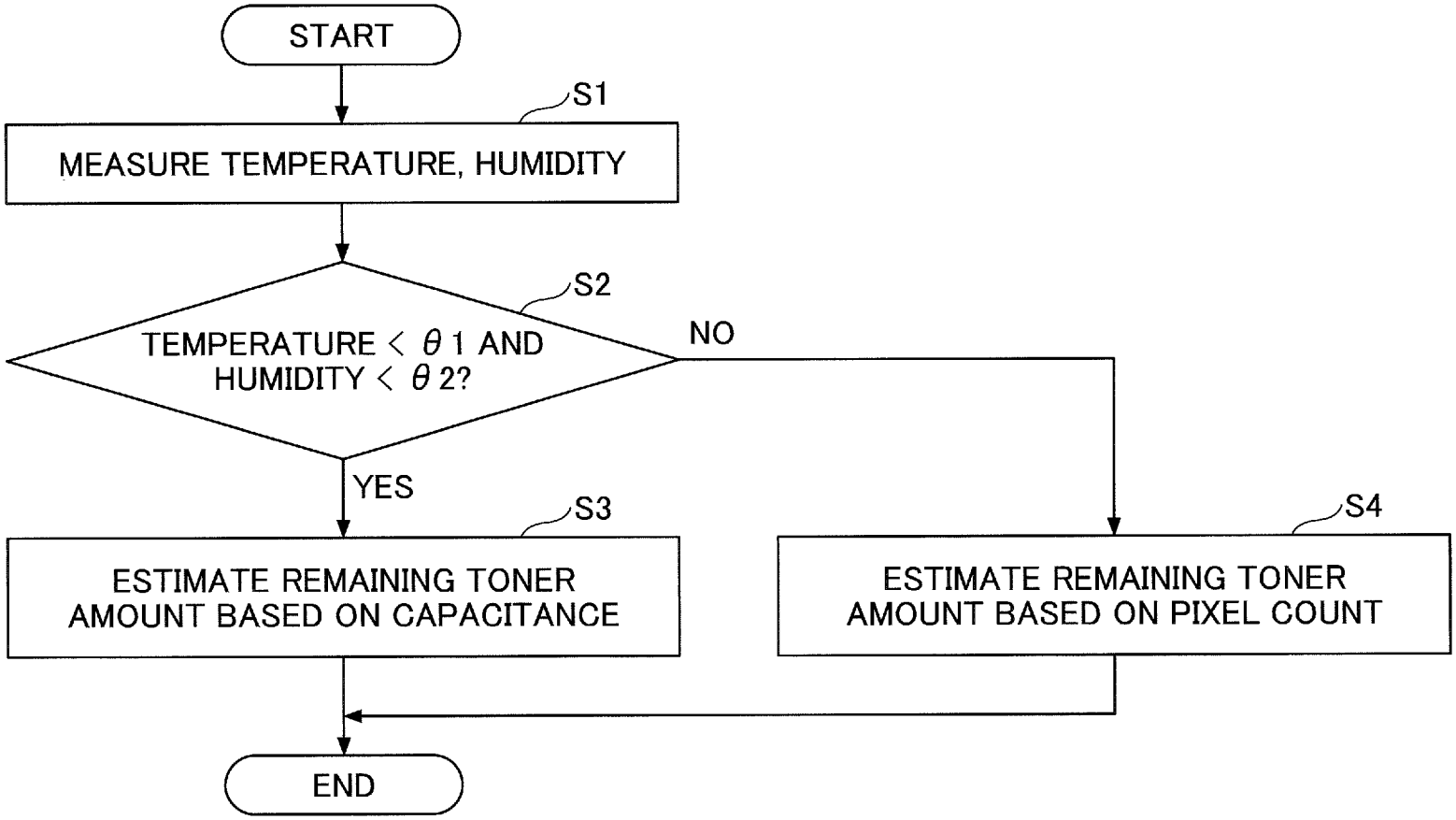
FIG. 8 is a flowchart of the remaining toner amount detection process according to an embodiment of the present invention.

Referring to FIG. 8, a remaining toner amount detecting method according to the present embodiment will be described. FIG. 8 is a flowchart of a remaining toner amount detection process performed by the remaining toner amount detecting apparatus 1 according to the present embodiment. The process of the flowchart illustrated in FIG. 8 is repeatedly executed during the operation by the remaining toner amount detecting apparatus 1 at any timing, for example, at predetermined cycles.

In step S1, the temperature and humidity detecting unit 106 detects the temperature and humidity in the image forming apparatus in which the toner bottle 60 is mounted, based on the output of the temperature and humidity sensor 40. The temperature and humidity detecting unit 106 outputs the information of the detected temperature and humidity to the estimation selecting unit 105.

In step S2, the estimation selecting unit 105 determines whether the temperature detected in step S1 is less than a predetermined temperature threshold value θ1 and the humidity detected in step S1 is less than a predetermined humidity threshold value θ2 (estimation selecting step). Here, the threshold values θ1 and θ2 are set to be the lower limits of temperature and humidity where the accuracy of the remaining toner amount detecting method of the capacitance method decreases. When the condition is satisfied (YES in step S2), the process proceeds to step S3, and when the condition is not satisfied (NO in step S2), the process proceeds to step S4.

In step S3, as a result of the determination of step S2, the temperature inside the apparatus is less than the threshold value θ1 and the humidity inside the apparatus is less than the threshold value θ2, and the temperature/humidity condition is such that the accuracy of the remaining toner amount detecting method of the capacitance method does not decrease, and, therefore, the estimation selecting unit 105 selects the first estimating unit 102 for outputting the remaining toner amount (estimation selecting step, first estimation step). That is, the estimation selecting unit 105 estimates the remaining toner amount based on the capacitance of the plate electrode pair 30.

In step S4, as a result of the determination of step S2, the temperature inside the apparatus is greater than or equal to the threshold value θ1 or the humidity inside the apparatus is greater than or equal to the threshold value θ2, and the condition is high temperature or high humidity such that the accuracy of the remaining toner amount detecting method of the capacitance method decreases, and, therefore, the estimation selecting unit 105 selects the second estimating unit 104 for outputting the remaining toner amount (estimation selecting step, second estimation step). That is, the estimation selecting unit 105 estimates the remaining toner amount based on the pixel count.

Note that in the condition determination of step S2, only either one of the temperature or the humidity may be used.

Figure 9:
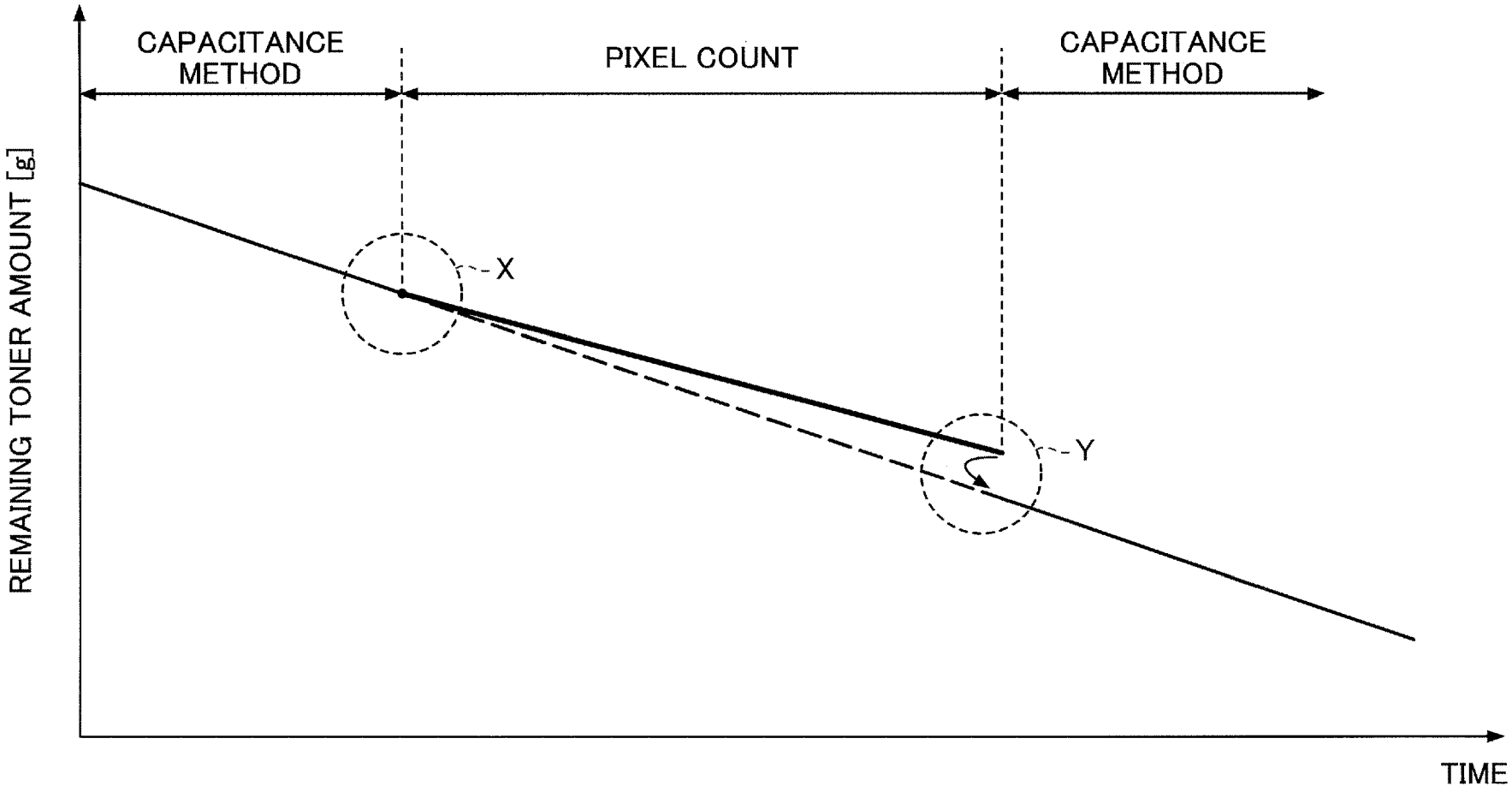
FIG. 9 is a diagram illustrating switching of a remaining toner amount detecting method according to an embodiment of the present invention.

Next, the effect of the remaining toner amount detecting apparatus 1 according to the present embodiment will be described with reference to FIG. 9. FIG. 9 is a diagram for describing the switching of the remaining toner amount detecting method. The vertical axis of FIG. 9 indicates the remaining toner amount in the toner bottle 60, and the horizontal axis indicates the usage time after the toner bottle 60 is attached to the image forming apparatus. That is, FIG. 9 illustrates the transition in which the remaining toner amount gradually decreases with the passage of the usage time.

The remaining toner amount detection by the capacitance method is more accurate than the remaining toner amount detection control by a strain sensor; however, the remaining toner amount detection by the capacitance method depends on the temperature and humidity environment, and the accuracy tends to decrease in the extreme HH (high temperature and high humidity) environment. When the humidity is extremely high (for example, 90% or more), the toner absorbs moisture in the air, and the dielectric constant of the toner is higher than that of water, and, therefore, the toner amount cannot be correctly detected, and the toner amount is detected to be greater than the actual toner amount. Further, at a high temperature (for example, 38° C. or more), the distance between the electrodes may change due to thermal expansion of the resin member to which the electrodes are attached, and the toner amount may not be correctly detected.

On the other hand, in the remaining toner amount detecting apparatus 1 according to the present embodiment, by performing the process illustrated in the flowchart of FIG. 8, the estimation selecting unit 105 uses, for outputting the remaining toner amount, either one of the remaining toner amount detecting method of the capacitance method by the first estimating unit 102 or the remaining toner amount detecting method based on the pixel count by the second estimating unit 104, based on the temperature and humidity in the apparatus in which the toner bottle is mounted. More specifically, when the temperature becomes greater than or equal to the predetermined temperature threshold value θ1 or when the humidity becomes greater than or equal to the predetermined humidity threshold value θ2, the estimating unit used for outputting the remaining toner amount is switched from the first estimating unit 102 to the second estimating unit 104, and when the temperature falls below the predetermined temperature threshold value θ1 and the humidity falls below the predetermined humidity threshold value θ2, the estimating unit used for outputting the remaining toner amount is switched from the second estimating unit 104 to the first estimating unit 102.

In the example of FIG. 9, the remaining toner amount is detected according to the remaining toner amount detection control by the capacitance method by the first estimating unit 102, during a period from the start of usage to a time point X when the temperature or the humidity in the apparatus is detected to be a predetermined value (for example, a temperature threshold value θ1=38° C. or a humidity threshold value θ2=90%).

Then, at the time point X, when the temperature or humidity inside the apparatus is detected to be a temperature threshold value θ1 or a humidity threshold value θ2, the detection accuracy of the capacitance method decreases, and, therefore, the method is switched to the remaining toner amount detection based on the pixel count by the second estimating unit 104. In the remaining toner amount detection by the pixel count, the number of pixels per printed image is counted; the detection error per image is small, and, therefore, the estimation accuracy of the remaining toner amount is higher than that of the capacitance method under high temperature or high humidity, so that the remaining toner amount can be detected more accurately.

Further, at the time point Y, when the temperature and humidity inside the apparatus are detected to be below the temperature threshold value θ1 and the humidity threshold value θ2, the remaining toner amount detecting method is returned from the remaining toner amount detection control by the pixel count by the second estimating unit 104 to the remaining amount detection control by the capacitance method by the first estimating unit 102.

As described above, by performing the process illustrated in the flowchart of FIG. 8, the remaining toner amount detecting apparatus 1 according to the present embodiment can switch the remaining toner amount detecting method from the capacitance method by the first estimating unit 102 to the method based on the pixel count by the second estimating unit 104 when the condition becomes a high temperature condition or a high humidity condition at which the accuracy of the remaining toner amount detecting method by the capacitance method decreases. Therefore, it is possible to avoid a decrease in the accuracy of estimating the remaining toner amount. Accordingly, it is possible to more accurately detect the remaining toner amount and more accurately detect near end of the toner bottle 60.

Incidentally, in the present embodiment, it is assumed that the temperature and humidity sensor 40 is mounted in the apparatus or a separate sensor is provided in the apparatus. However, the value measured by the temperature and humidity sensor 40 may differ from the actual temperature and humidity around the toner bottle 60, and, therefore, even if the temperature and humidity sensor 40 detects the threshold values θ1 and θ2, the actual temperature and humidity around the toner bottle 60 may be less than the threshold values. In this case, the remaining toner amount detecting method may be inadvertently switched, even though it is not necessary to switch to the remaining toner amount detection by the pixel count.

Therefore, when switching from the remaining toner amount detection by the pixel count to the remaining toner amount detection by the capacitance method, or when switching from the remaining toner amount detection by the capacitance method to the remaining toner amount detection by the pixel count, the switching may be delayed until the estimation selecting unit 105 actually switches the estimating unit to be used for outputting the remaining toner amount. Accordingly, an environmental condition in which the detected value of the temperature and humidity sensor 40 and the temperature and humidity around the toner bottle 60 are close to each other can be realized, so that the control method can be switched at a more correct timing and it is possible to prevent the remaining toner amount detecting method from switching needlessly.

Further, in the remaining toner amount detecting apparatus 1 according to the present embodiment, it is preferable that the electrode pair for measuring the capacitance is the plate electrode pair 30 made of flat plate electrodes. Accordingly, the distance between the electrodes facing each other is constant, and, therefore, it is possible to prevent the impact of the uneven distribution of toner in the toner bottle 60, so that the value of the measured capacitance can be stabilized. Thus, the accuracy in estimating the remaining toner amount can be improved.

As described above, the present embodiment has been described with reference to the specific examples. However, the present disclosure is not limited to these specific examples. The specific examples, to which design modifications have been appropriately made by those skilled in the art, are also encompassed by the present disclosure as long as they possess the features of the present disclosure. The elements provided in each of the specific examples described above, and the arrangement, conditions, shape, and the like, may be appropriately modified without being limited to those exemplified. Each element provided by each of the above-described specific examples may vary in combination as appropriate, unless there is a technical inconsistency.

In the embodiment described above, one plate electrode pair 30 is disposed outside of the toner bottle 60 as an example; however, the number of electrode pairs may be at least one, and a plurality of plate electrode pairs 30 may be disposed along the longitudinal direction of the toner bottle 60.

In the above-described embodiment, the plate electrode pair 30 is disposed outside the toner bottle 60. However, for example, a pair of electrodes having a shape other than a flat plate, such as an arc shape illustrated in FIGS. 4 to 6, may be disposed.

According to one embodiment of the present invention, the remaining toner amount can be detected more accurately.

The remaining toner amount detecting apparatus, the remaining toner amount detecting method, and the recording medium are not limited to the specific embodiments described in the detailed description, and variations and modifications may be made without departing from the spirit and scope of the present invention.

What is claimed is:

1. A remaining toner amount detecting apparatus for detecting a remaining toner amount in a toner bottle, the remaining toner amount detecting apparatus comprising:

at least one pair of electrodes that are configured to face each other with the toner bottle interposed between the electrodes;

a first estimator configured to estimate the remaining toner amount based on a capacitance between the electrodes of the at least one pair of electrodes;

a second estimator configured to estimate the remaining toner amount by counting a number of pixels in a printed image; and an estimation selector configured to use either one of the first estimator or the second estimator to output the remaining toner amount, based on a temperature or a humidity inside an apparatus in which the toner bottle is mounted.

2. The remaining toner amount detecting apparatus according to claim 1, wherein the estimation selector switches an estimator, to be used for outputting the remaining toner amount, from the first estimator to the second estimator, upon detecting that the temperature or the humidity has become greater than or equal to a predetermined threshold value, and the estimation selector switches the estimator, to be used for outputting the remaining toner amount, from the second estimator to the first estimator, upon detecting that the temperature or the humidity has fallen below the predetermined threshold value.

3. The remaining toner amount detecting apparatus according to claim 1, wherein the estimation selector delays an operation of actually switching an estimator, to be used for outputting the remaining toner amount, between the first estimator and the second estimator, after determining to switch the estimator to be used between the first estimator and the second estimator based on the temperature or the humidity.

4. The remaining toner amount detecting apparatus according to claim 1, wherein the electrodes of the at least one pair of the electrodes are plate electrodes.

5. A remaining toner amount detecting method of detecting a remaining toner amount in a toner bottle, the remaining toner amount detecting method comprising:

estimating, as a first estimation value, the remaining toner amount based on a capacitance between electrodes of at least one pair of electrodes that are configured to face each other with the toner bottle interposed between the electrodes;

estimating, as a second estimation value, the remaining toner amount by counting a number of pixels in a printed image; and using either one of the first estimation value or the second estimation value to output the remaining toner amount, based on a temperature or a humidity inside an apparatus in which the toner bottle is mounted.

6. A non-transitory computer-readable recording medium storing a remaining toner amount detecting program that causes a computer to execute a process for detecting a remaining toner amount in a toner bottle, the process comprising:

estimating, as a first estimation value, the remaining toner amount based on a capacitance between electrodes of at least one pair of electrodes that are configured to face each other with the toner bottle interposed between the electrodes;

estimating, as a second estimation value, the remaining toner amount by counting a number of pixels in a printed image; and using either one of the first estimation value or the second estimation value to output the remaining toner amount, based on a temperature or a humidity inside an apparatus in which the toner bottle is mounted.

* * * * *